United States Patent [19]

Sauder

[11] 4,267,481

[45] May 12, 1981

[54] SPARK PLUG WITH HOT/SHARP GROUND ELECTRODE

[76] Inventor: Larry D. Sauder, Rte. 2, Box 545, Lockport, La. 70374

[21] Appl. No.: 29,362

[22] Filed: Apr. 12, 1979

[51] Int. Cl.[3] ..... H01T 13/32

[52] U.S. Cl. ..... 313/139; 313/141

[58] Field of Search ..... 313/139, 141, 142

[56] References Cited

U.S. PATENT DOCUMENTS

| | | | |
|---|---|---|---|
| 1,041,835 | 10/1912 | McIntyre | 313/141 X |
| 1,087,897 | 2/1914 | Talbert | 313/139 X |
| 1,138,797 | 5/1915 | Schmidt | 313/141 X |
| 1,306,304 | 6/1919 | Herz | 313/141 X |
| 1,335,793 | 4/1920 | Olson | 313/141 |
| 1,492,515 | 4/1924 | Johns | 313/141 |
| 1,533,979 | 4/1925 | Euler | 313/141X |
| 1,538,870 | 5/1925 | Champion | 313/141 X |
| 2,097,460 | 11/1937 | Innes, Jr. | 313/141 |
| 2,845,566 | 7/1958 | Regar | 313/141 X |

*Primary Examiner*—Palmer C. Demeo

*Attorney, Agent, or Firm*—LeBlanc, Nolan, Shur & Nies

[57] ABSTRACT

A spark plug for internal combustion engines, both two-stroke and four-stroke cycle, in which the insulating core, the central electrode and the conductive metal casing which carries the insulating member and electrode together with the gasket or sealing structure are essentially identical to conventional spark plugs. The projecting portion of the central electrode and the "ground" electrode have a structural and functional relationship different from commercially available plugs. The central electrode projects from the inner end of the metal spark plug casing and the ground electrode, made from a thin flat strip of conventional ground electrode material, has a substantially greater length than that of normal plugs. The ground electrode projects further into the combustion chamber than does the center electrode and is reverse bent to place a relatively long extent of gap area parallel to the projected portion of the central electrode, which configuration maintains the ground electrode body at a same high temperature all along the length of the gap. The thin, or "sharp", edge of the flat ground strip, at the gap area, is arranged normal to a plane through the sparking part of the ground electrode and the axis of the central electrode resulting in an even, intense sparking and corona effect and better ionization of gases all along the gap which provides more complete ignition, eliminates carbonizing and results in cleaner and efficient burning of the combustion charge.

12 Claims, 10 Drawing Figures

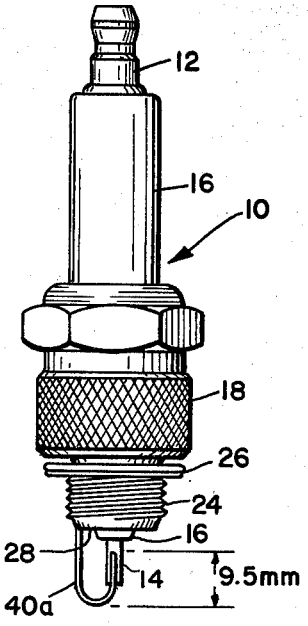
FIG. 1
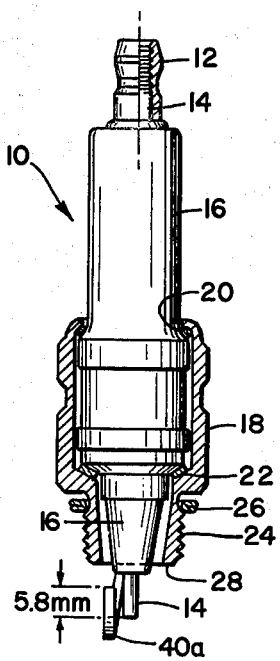
FIG. 2
FIG. 3
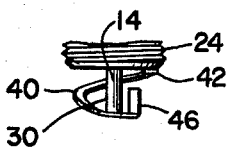
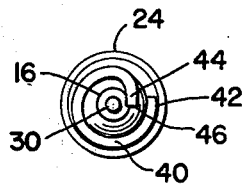
FIG. 4
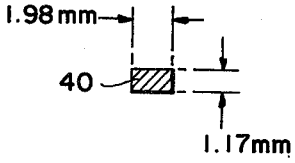
FIG. 10
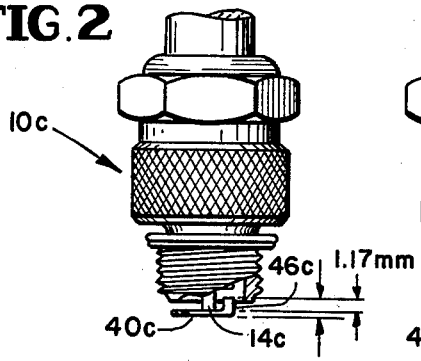
FIG. 5
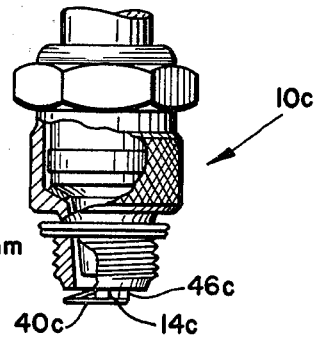
FIG. 6
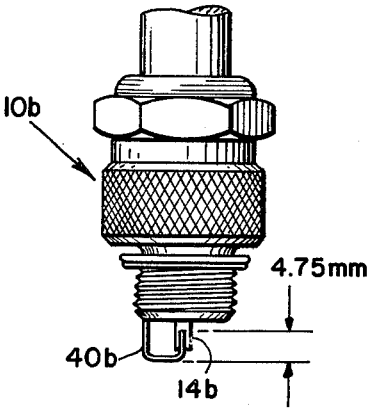
FIG. 8
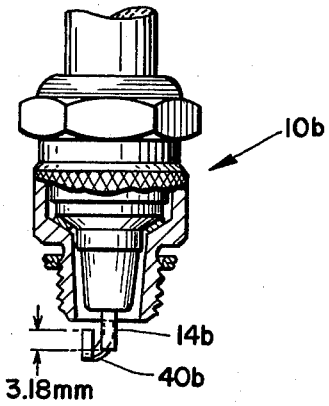
FIG. 9
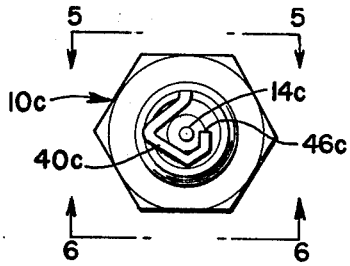
FIG. 7

SPARK PLUG WITH HOT/SHARP GROUND ELECTRODE

BACKGROUND OT THE INVENTION

This invention relates to an improvement in spark plugs and more particularly concerns a novel construction of the electrodes resulting in a longer, as well as a greater extent of the bodies of both electrodes at the gap location. The construction enables better maintenance and increased life of a set gap and enhances maintaining a constant temperature all along the gap. Making the ground electrode longer than those generally found in previously known spark plugs, and also constructing the ground electrode with a substantial body surface area, enables that electrode, particularly at the gap location, to be maintained at a high and constant temperature causing a more even ionization of the gases which results in more complete and cleaner efficient burning of the combustion fuel. The present invention eliminates problems, such as the insulator becoming heavily coated with oxides when the plug itself runs too hot, rapid wearing of the ground electrode by burning away of the firing area, and heavy deposits of carbon caused by cool points. The present electrode configuration by maintaining large gapping surface along a "sharp" area with a constant high temperature right at the gapping area avoids the foregoing problems when a plug insulator is too hot or the points are too cool.

There are many developments found in the prior art wherein attempts have been made to solve the foregoing problems. However, none of the art, insofar as applicant is aware, uses the idea of a hot/sharp edge relationship between the ground and central electrodes as well as incorporating an increased total length of the ground electrode by providing a specialized strip form configuration of that ground electrode bent or made with appropriate bend into a spiral form or arched shape with the terminal end gap portion of the ground electrode bent back toward the main body of the spark plug. Prior art known to applicant and which disclose special configurations of electrodes are seen in the following U.S. Pat. Nos. 1,087,897 to C. E. Talbert, dated Feb. 17, 1914; 1,364,262 to A. J. Faber, dated Jan. 4, 1921; 1,495,499 to J. Stanislawski, dated May 27, 1924; 2,060,340 to M. O'Marra, dated Nov. 10, 1936; 2,294,248 to J. J. Smulski, dated Aug. 25, 1942; 2,487,535 to to J. J. Fernandez, dated Nov. 8, 1949; 2,324,330 to H. R. Schnabel, dated June 6, 1967; 4,029,986 to J. H. Lara et al, dated June 14, 1977.

As evidenced by the above noted prior art patents many previously known spark plugs have proposed curved or spiral shapes on the ground electrode. None have a grounded electrode with a shape, body and relationship to the center electrode as is proposed by this present invention. The A. J. Faber patent does disclose a ground electrode which at first blush appears close to applicant's invention but it teaches that the ground electrode is a very small round wire coiled around the insulator with its end bent to first parallel the center electrode, then passing into a $\frac{3}{4}$ circular portion coaxial with and spaced from the center electrode, then bent back toward the insulator, paralleling and spaced from the center electrode the same gap as the spacing of the $\frac{3}{4}$ circular portion. The small wire lacks the rigid substantial body material and the provision of the flat strip terminal end portion of applicant's ground electrode that results in the beneficial hot/sharp sparking portion.

SUMMARY OF THE INVENTION

In accord with the foregoing discussion, a primary object of the present invention resides in the provision of a novel internal combustion engine spark plug in which the center electrode extends beyond the end of the plug casing and wherein the second electrode is made from a flat strip with substantial length and a reverse bent terminal portion oriented at the gap to provide an elongated hot/sharp spark plug relationship between electrodes.

Further objects reside in the particular configurations of the second or ground electrode and the structural interrelationship between the two electrodes at the gap area to accommodate the unique plug and its advantages to automotive engines, heavy truck engines and small two-stroke cycle engines. In all embodiments the ground electrode is a flat strip with its terminal gapping portion made as a reverse bend and with a narrow edge of the flat strip facing and gapped from the center electrode. In the plug for heavy truck and automotive engines the required length of the ground electrode is enabled by an arched and partially encircling configuration whereas in the small engine spark plugs (outboard motors, lawn mowers, etc.) the shallow combustion chamber depth at top center requires a flat spiral form configuration of the ground electrode to provide the required length of flat strip. It is the length of flat strip and the length of the "sharp" edge gapping area which accomplishes the hot/sharp spark with commensurate increased ionization and even cleaner burning of the combustion mixture, and the length can be made different to make the plug a hotter or colder running plug for different operating requirements.

Further novel features and other objects of this invention will become apparent from the following detailed description, discussion and the appended claims taken in conjunction with the accompanying drawings.

BRIEF DESCRIPTION OF DRAWINGS

Preferred structural embodiments of this invention are disclosed in the accompanying drawingg, in which:

FIG. 1 illustrates a spark plug with electrodes constructed in accord with the present invention in an embodiment for conventional automotive engines;

FIG. 2 is a side view, partially in section of the spark plug shown in FIG. 1;

FIGS. 3 and 4 are detail side and end views of an ideal configuration and relationship of the electrode of a spark plug accordingly to this invention;

FIGS. 5, 6 and 7 illustrate lower portions of a spark plug embodiment for small engines, incorporating the inventive features, FIGS. 5 and 6 being partially sectioned and looking at the spark-plug from different side views shown by lines 5—5 and 6—6 respectively of the bottom view shown in FIG. 7;

FIGS. 8 and 9 are partial views similar to FIGS. 1 and 2 illustrating an embodiment of spark plug for heavy duty truck and stationary engines in accord with the present invention where the electrodes cannot project into a combustion chamber as far as permitted in automotive engines; and FIG. 10 is an enlarged cross-section of the flat strip electrode illustrating the dimensions.

GENERAL DESCRIPTION

FIG. 1 is a side view illustrating a spark plug 10 which, excepting for the lower end arrangement where the two electrode structures and their gapping relationship are shown, can be made in a manner like other commercially available spark plugs which have a spark plug lead terminal connector 12 and a center electrode 14 made from conventional electrode metal alloys supported by an insulator 16. The plug casing 18, which can be made from one or more parts, surrounds the lower end of the insulator 16 and secures it in the casing, in a conventional manner, by suitable gaskets 20 and 22. The lower end of the casing 18 is reduced in diameter and is externally threaded at 24 for screw-threaded insertion into the spark plug opening of an internal combustion engine. As illustrated, a compression gasket 26 is shown on the threaded sleeve, however, it is to be understood that the more recent tapered compression seat used on present day spark plugs can be used.

The terminal end of the insulator 16 extends beyond the transverse plane through the end periphery 28 of the threaded sleeve of casing 18 in the plug of FIGS. 1 and 2 and terminates short of the transverse plane in the plugs shown in FIGS. 3–9. Plug 10 (FIG. 1) represents an embodiment for automotive engines which can accommodate a longer terminal portion of the center electrode than do the heavy duty engines and the smaller engines, plugs for which are represented by FIGS. 3–9. The foregoing components are essentially conventional on most present day spark plugs.

With specific reference to FIGS. 3 and 4, the terminal portion 30 of center electrode 14 projects beyond the transverse plane at the end surface of the hollow threaded end 24 of the casing, it being preferred that the spark gap area be located outside of the space surrounded by the threaded end portion 24. The second electrode 40 is a flat strip of electrode metal alloy which has one end 42 fastened, as by welding, to the peripheral end surface of the casing end 24. Electrode strip 40 is shaped with a slightly converging helical configuration to provide a substantial length of strip material extending away from the threaded end and curved around the center electrode 30 to a location axially spaced from the threaded casing end a distance slightly greater than the projected part of the center electrode where it passes into a short lateral bend 44 and then into a reverse bend terminating in the spark gap portion 46 parallel to and spaced lateral from the projected end of center electrode 30. The cross-section dimensions of the flat electrode should be at least 1.98 mm×1.17 mm (0.978″×0.045″) which is the dimensions of electrodes which have been utilized in satisfactory spark plug configurations accomplishing the purposes of this invention. The dimensions of electrode 40 provide a relatively rigid body with substantial surface area for the ground electrode and what is referred to herein as the sharp sparking edge. The curved and bent ground electrode configuration of all embodiments results in the sparking or gapped area of the electrodes consisting of a parallel and adjacent reverse bent terminal portion of the ground electrode and the lateral adjacent surface of the projected end of the center electrode. Note the spark gap terminal end portion 46 of the ground electrode is parallel to and arranged so its long cross section dimension is disposed in alignment with the axis of the central electrode. The depth of the operative combustion space within a combustion chamber will determine the distance which the electrode arrangement can project into the combustion space. Most automotive engines have sufficient space for the ground electrode to project 12.7 mm (0.5″) in which case the desired ideal length of the spark gap area is approximately 6.35 mm (0.25″). By projecting the terminal end of the center electrode at least 9.53 mm (0.0375″) into the combustion chamber a corona effect with resultant ionization zone, at least 9.53 mm long, occurs in a zone surrounding the gap.

The intentional long length and flat strip form of the ground electrode, which has been found to be on the order of 5 times the length of the spark gap area, projected into the combustion chamber, results in a large extent of body and of surface area exposed to the heat of combustion gases. Actual length of the electrode strip can be made longer or shorther to control the electrode temperature as desired for different engine compressions.

This arrangement of the length of electrode strip in the combustion chamber heats the ground electrode, makes it stay hot and stay essentially at an even temperature pre-determined for specific engines, along the length of the gap. More body and surface area kept at an even high temperature effectively preheats the combustion charge, causes even sparking with commensurate maximum ionization of the gases which in turn provides a more complete ignition with cleaner burning preventing build-up of oxides and effectively eliminates carbonizing on the electrodes. The relative heavy ground electrode and its disposition with the wide cross-section dimension aligned with the axis of the center electrode results in the gapped relationship being maintained over a longer operational period than is obtained in conventional spark plugs. Gap dimensions are easily set in accord with specific engine requirements.

The configuration of the ground electrode of FIGS. 3 and 4 is ideal but somewhat more difficult to make and assemble than the configurations of FIGS. 1, 2, 8 and 9, in which the desired length and structural relationship of the strip of ground electrode can be obtained by shaping the strip in an arched form. In the automotive spark plug 10 of FIGS. 1 and 2 the ground electrode **40*a* is configured as an arch which projects the ground electrode approximately 12.7 mm (0.5″) into the combustion chamber and is slightly curved and disposed so the reverse bent terminal end is gapped and positioned in the required sharp edge gap area relationship, and provides a spark area approximately 5.8 mm (0.23″) in length. In the heavy duty engine spark plug 10*b* of FIGS. 8 and 9 the center electrode 14*b* projects approximately 4.75 mm (0.187″) into the combustion chamber, the arched ground electrode 40*b*** is made with a flat arch configuration and projects into the combustion chamber approximately 6.35 mm (0.25″) and the length of the gap area is approximately 3.18 mm (0.125″), still maintaining the required sharp edge disposition of the ground electrode sparking portion aligned with the axis of the center electrode.

The spark plug embodiment **10*c* illustrated in FIGS. 5, 6 and 7 is for small two-stroke cycle engines which do not permit a very great projection of the electrodes into the combustion chamber. Accordingly, to obtain the necessary length of ground electrode of strip form, the ground electrode 40*c* extends only 1.78 mm (0.070″) into the chamber and is configured with a sharp 90° bend then into a series of straight successively bent sections to provide a spiral form shape converging toward the center electrode 14c where the ground electrode is reverse bent to a terminal spark gap portion 46c** with a spark area length of at least 1.17 mm (0.046"). It has been found that this configuration provides very long life and fast starting when used in connection with outboard engines.

Use of the automotive and heavy duty truck spark plug configurations have resulted in a 15% increase in fuel consumption efficiency for at least 10,000 miles of operation. On the spark plug for 2 stroke cycle engines, particularly for outboard motors experimental uses have indicated from 15% to 20% increase in fuel consumption efficiency, but, over and above that saving in fuel, it has been found that an outboard engine with spark plug incorporating this invention will start immediately, the horsepower output remains high and the plug will outlast the life of conventional plugs by at least 3 to 1, and probably longer.

The invention may be embodied in other specific forms without departing from the scope, spirit or essential characteristics thereof. The present embodiments are, therefore, to be considered in all respects as illustrative and not restrictive, the scope and spirit of the invention being indicated by the appended claims rather than by the foregoing description, and all changes which come within the meaning and range of equivalency of the claims are, therefore, intended to be embraced therein.

What is claimed and desired to be secured by Letters Patent is:

1. A spark plug comprising: an elongate central electrode; an insulating body around and embedding said central electrode; a conductive metal casing means coaxial on and rigidly carrying said insulating member with an externally threaded cylindrical end portion coaxial with and radially spaced apart from one end portion of said central electrode; a second electrode secured in conductive relationship on said cylindrical end portion; said one end portion of said central electrode having a terminal portion projecting beyond a plane through the terminal end surface of said cylindrical end portion; said second electrode consisting of a flat metal strip having its cross section width to thickness ratio essentially constant throughout and approaching 2:1 and having a fixed end and a free end, the fixed end being structurally integrally secured to the metal casing, the central portion of said electrode strip extending away from said threaded end portion a distance beyond the end of the projected end portion of said central electrode, passing at least partially around said central electrode in spaced relation thereto and configured so its free end has a reverse bend disposing a terminal portion of said free end of said electrode strip so that it projects back toward said insulating body, is parallel to, is spaced in a gapped relationship to and is disposed with its widest surfaces essentially radial to the axis of said central electrode; the entire second electrode being located in a space within the theoretical cylinder defined through the base of the threads on the said threaded end portion of the metal body.

2. A spark plug as defined in claim 1, wherein said terminal end portion of said strip electrode is disposed at least 90° around the central electrode axis from the said fixed end of the strip electrode.

3. A spark plug as defined in claim 2, wherein the total length of said strip electrode is at least 5 times greater than the length dimension of said strip terminal end portion which parallels and is adjacent to said central electrode and provides the spark gap relationship.

4. A spark plug as defined in claim 3, wherein the cross sectional dimension of said flat strip electrode is approximately 1.98 mm$\times$1.17 mm.

5. A spark plug as defined in claims 1, 2, 3 or 4 wherein said strip electrode is configured as an arch.

6. A spark plug as defined in claim 5, wherein the dimensional length of the terminal projecting portion of said central electrode is at least approximately 4.75 mm and the length of said terminal gapped portion of said strip electrode is at least approximately 3.15 mm.

7. A spark plug as defined in claim 6, wherein said terminal projecting portion of said central electrode is approximately 9.5 mm and the length of said terminal gapped portion of said strip electrode is approximately 5.8 mm.

8. A spark plug as defined in claims 1, 2, 3 or 4, wherein the major portion of said strip electrode between the fixed end and the bent free end is configured as a converging spiral form.

9. A spark plug as defined in claim 8 wherein said terminal projecting portion of said central electrode is at least approximately 1.78 mm in length and said terminal gapped portion of said strip electrode is at least 1.17 mm in length.

10. A spark plug as defined in claim 9, wherein said spiral form is a converging helical form.

11. A spark plug as defined in claim 9, wherein said spiral form constitutes a plurality of successive laterally bent portions of said strip.

12. A spark plug as defined in claims 1, 2, 3 or 4, wherein said terminal free end portion of said electrode strip which provides the spark gap area has a length dimension at least as great as the width dimension of said electrode strip.

* * * * *

UNITED STATES PATENT AND TRADEMARK OFFICE

CERTIFICATE OF CORRECTION

PATENT NO. : 4,267,481

DATED : May 12, 1981

INVENTOR(S) : Larry D. Sauder

It is certified that error appears in the above-identified patent and that said Letters Patent are hereby corrected as shown below:

Column 4, line 7, change "(0.0375)" to --(0.375)--.

*Column 4, line 17, change "shorther" to --shorter--.

Signed and Sealed this

*Fourth* Day of *August 1981*

[SEAL]

*Attest:*

GERALD J. MOSSINGHOFF

*Attesting Officer*

*Commissioner of Patents and Trademarks*